US005758948A

United States Patent [19]

Hale

[11] Patent Number: 5,758,948

[45] Date of Patent: Jun. 2, 1998

[54] SEASONAL LIGHT DISPLAY DEVICE

[76] Inventor: Gregory S. Hale, 812 E. Broadway, Waukesha, Wis. 53186

[21] Appl. No.: 677,832

[22] Filed: Jul. 10, 1996

[51] Int. Cl.[6] ..... F21P 1/00; F21P 1/02; A47G 33/06

[52] U.S. Cl. ..... 362/123; 362/123; 362/249; 428/8; 428/9

[58] Field of Search ..... 362/102, 123, 362/109, 249; 428/8, 9

[56] References Cited

U.S. PATENT DOCUMENTS

| | | | |
|---|---|---|---|
| 2,087,537 | 7/1937 | Finkel | 362/102 |
| 2,414,866 | 1/1947 | Glaser | 362/123 |
| 2,708,324 | 5/1955 | Wedden | 362/123 |
| 3,313,929 | 4/1967 | Schiavone | 362/102 |
| 3,704,366 | 11/1972 | Korb et al. | 362/123 |
| 3,819,459 | 6/1974 | Wren | 362/123 |
| 4,404,621 | 9/1983 | Mauro | 362/123 |
| 4,620,270 | 10/1986 | Laakso | 362/123 |
| 4,734,301 | 3/1988 | McKinney | 428/8 |
| 4,806,392 | 2/1989 | Dixon | 362/123 |
| 4,847,123 | 7/1989 | Armstead et al. | 428/9 |
| 5,053,931 | 10/1991 | Rushing | 362/102 |
| 5,359,502 | 10/1994 | Cantin | 362/249 |
| 5,488,549 | 1/1996 | Miller et al. | 362/123 |
| 5,609,412 | 3/1997 | Contigiani | 362/123 |

*Primary Examiner*—Ira S. Luzarus
*Assistant Examiner*—Matthew Spark
*Attorney, Agent, or Firm*—Ryan, Maki, Mann & Hohenfeldt

[57] ABSTRACT

A lighting display device simulates a decorated, lighted tree, when illuminated. A plurality, preferably 15 elongated support members are attached at each end to a central shaft. The upper end is hingedly attached to a stationary collar while the lower end is attached to a collar which is axially moveable along the shaft. A hinge is formed in each of the support members at a point spaced away from the ends of the support members. Each of the support members has a generally C-shaped configuration with an open side facing the shaft and a plurality of spaced openings through a surface of each of the support members faces away from the shaft. Each of the openings is adapted to receive a light bulb from a string of lights, and the channel is adapted to receive a plurality of light sockets supporting the lights. When the collar is moved axially along the shaft, each of the support members is moved, from a substantially straight position suitable for storage of the device, to an erect position wherein each of the support members is folded outwardly from the shaft at the hinge point. The axially moveable ends of the support members are secured to the shaft thus forming a conical tree-like structure.

10 Claims, 5 Drawing Sheets

Fig. 3
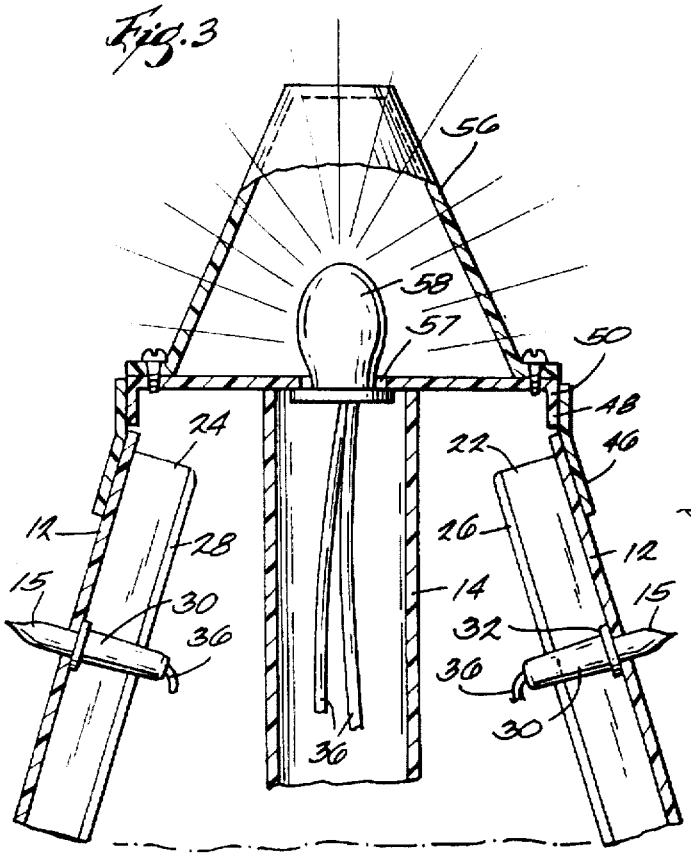
Fig. 2
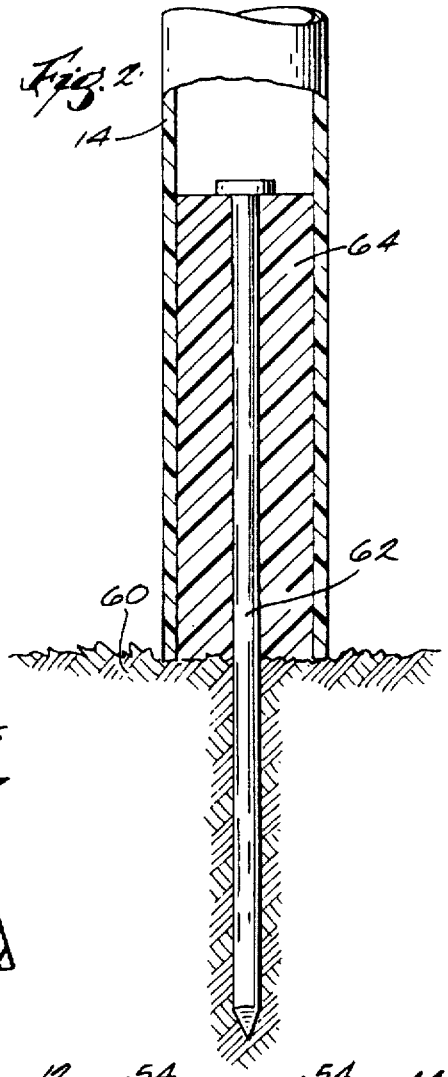
Fig. 4
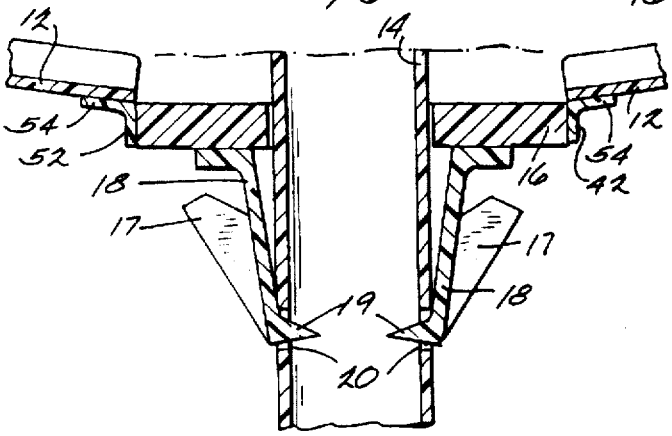
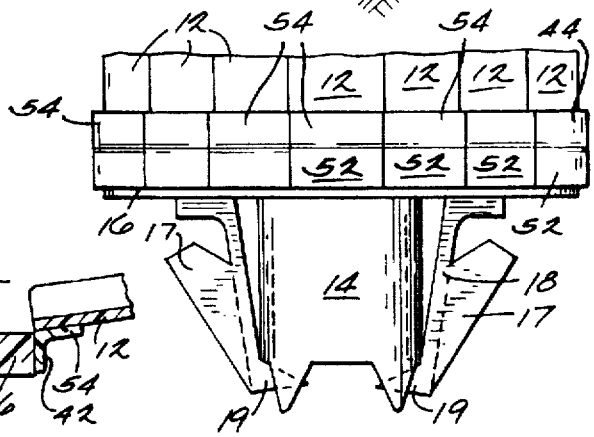
Fig. 5

SEASONAL LIGHT DISPLAY DEVICE

FIELD OF THE INVENTION

The present invention relates to lighted display devices such as simulated Christmas tree. More specifically the invention relates to a collapsible light-supporting device that, when illuminated, at night resembles a lighted outdoor tree or similar lighted object.

BACKGROUND OF THE INVENTION

Various types of artificial Christmas trees have been utilized for indoor and outdoor usage. Often, to provide an outdoor lighted tree, either a living tree or some type of framework that can support the Christmas lights in a shape resembling a tree, when lighted at night, have been utilized.

SUMMARY OF THE INVENTION

The present invention provides a collapsible and erectable structure adapted to hold one or more strings of conventional Christmas tree lights, and which, when erected, assumes a conical shape resembling a lighted Christmas tree when illuminated and viewed in darkness.

In accordance with one of its aspects, the invention provides a collapsible light supporting device adapted to hold one or more strings of conventional Christmas lights in a shape simulating a tree when erected and illuminated.

In accordance with a related aspect of the invention, a framework is provided which includes a plurality of channels for holding a string of lights. In accordance with a further aspect of the invention the channels for receiving the lights are configured to receive a string of commercially available lights installed in plurality of sockets generally wired together to form a string of lights. Preferably the channels are provided with openings for receiving and supporting the individual lights. In accordance with a further aspect of the invention a conical, treelike structure can be collapsed, much in the manner of an umbrella, for off-season storage.

In accordance with a further aspect of the invention the conical structure is provided with a supporting base which preferably is provided at its lower end with a projecting spike which can be inserted into the ground, by hammering, even if the ground is frozen.

In accordance with yet further aspects of the invention, the structure is preferably formed of plastic channel-shaped strips connected to the upper end of a central shaft which resembles a tree trunk and which are adapted to be pivoted away therefrom into a conically shaped superstructure for use.

In accordance with still further aspects of the invention, the lower ends of each strip are connected to a collar, which forms an interconnecting structure for the lower end of the conical superstructure, which is slidable axially along the central shaft. In accordance with still further aspects of the invention, each rib is provided with a pivoting joint nearer the base of the treelike structure than its top so that, when the collar is moved upwardly on the central shaft, the strips will each pivot outwardly to provide a uniform conically-shaped structure.

In accordance with still further aspects of the invention, other shapes of lighted displays of varying colors are provided for different holidays or special days such as Valentine's Day or Halloween.

Briefly, a lighting display device of the invention simulates a decorated, lighted tree, when illuminated. A plurality, preferably 15, elongated support members are attached at each end to a central shaft. The upper end is hingedly attached to a stationary collar while the lower end is attached to a collar which is axially moveable along the shaft. A hinge is formed in each of the support members at a point spaced away from the ends of the support members. Each of the support members has a generally C-shaped configuration with an open side facing the shaft and a plurality of spaced openings through a surface of each of the support members faces away from the shaft. Each of the openings is adapted to receive a light bulb from a string of lights, and the channel is adapted to receive a plurality of light sockets supporting the lights. When the collar is moved axially along the shaft, each of the support members is moved, from a substantially straight position suitable for storage of the device, to an erect position wherein each of the support members is folded outwardly from the shaft at the hinge point. The axially moveable ends of the support members are secured to the shaft thus forming a conical tree-like structure.

Further objects and advantages of the invention will be apparent from the following detailed description, the claims and the accompanying drawings.

BRIEF DESCRIPTION OF THE DRAWINGS

FIG. 2 is a fragmentary cross sectional view taken along line 2—2 of FIG. 1;

FIG. 3 is a fragmentary sectional view taken along line 3—3 of FIG. 1;

FIG. 4 is a fragmentary central sectional view showing in expanded detail the relationship between the central shaft and the elongated light supporting members;

FIG. 5 is fragmentary view showing the lower strip connecting assembly in the storage position;

DETAILED DESCRIPTION

Figure 1:
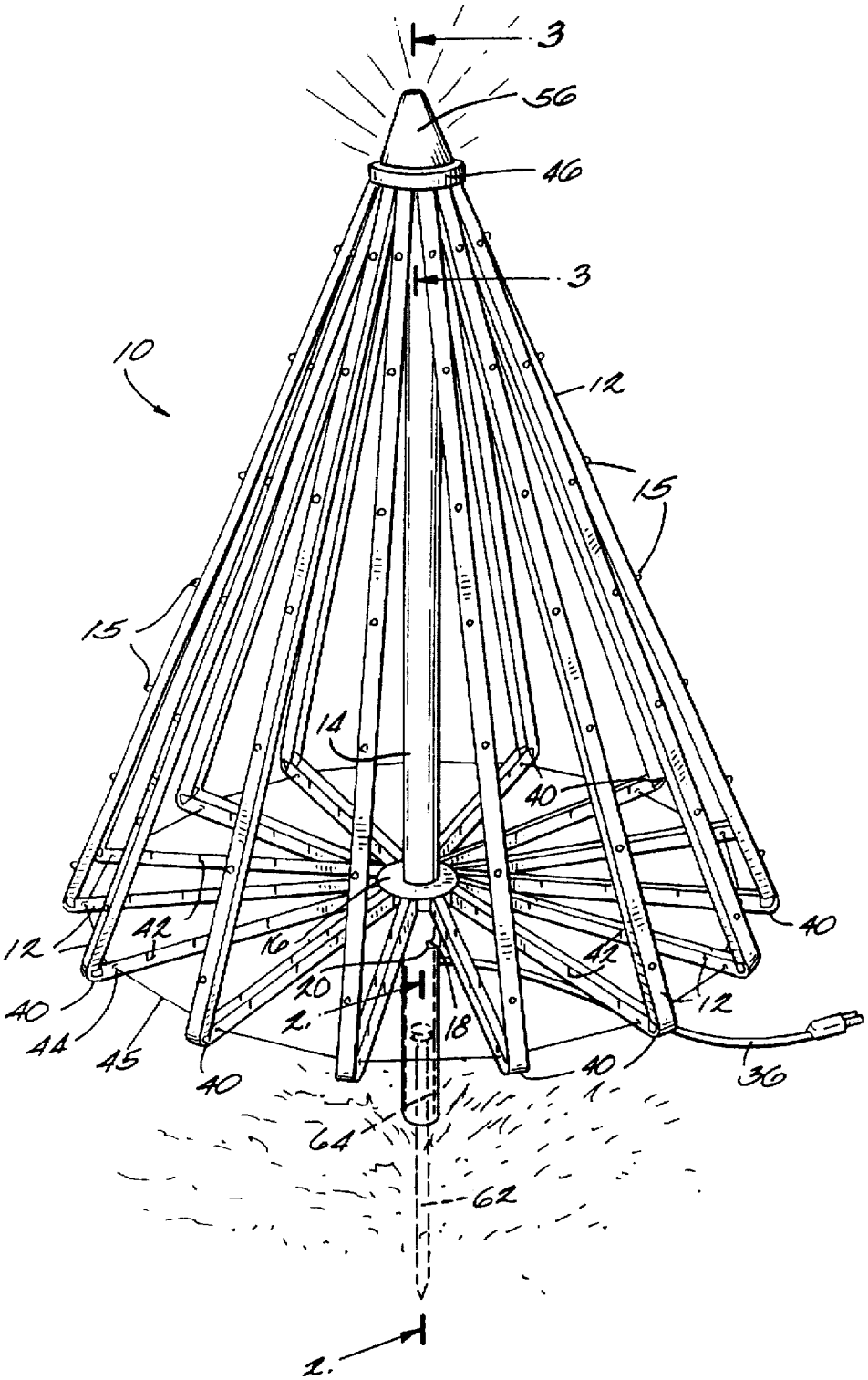
FIG. 1 is a perspective view showing a lighting device of this invention in the assembled, erect position.

Referring more particularly to the drawings, a lighting device 10 of this invention is shown in the assembled and erect position in FIG. 1. Device 10 is adapted to support at least one string of conventional Christmas tree lights and to resemble, when illuminated, a lighted Christmas tree, when viewed at night or in darkness. As will be further explained, such a device can be provided either for indoor or outdoor display.

Device 10 includes a plurality, around its circumference, of elongated light supporting strips 12. Strips 12 are all mounted concentrically around a central supporting shaft 14. Each strip 12 is preferably in the form of a generally C-shaped channel and is adapted to support a plurality of small miniature or small light bulbs 15 provided in a conventional string of lights. Each of the strips 12 is connected at its lower end to a sleeve 16 which is concentrically slidably mounted around a central supporting shaft 14. As best seen in FIG. 4 the lower end of supporting sleeve 16 is provided with a plurality, preferably a pair, of clips 18 which have inwardly extending tips or ends 19, which are adapted to be received in openings or slats 20 provided in shaft 14 at an elevation which supports the strips 12 in a generally conical shape as shown in FIG. 1.

Figure 7:
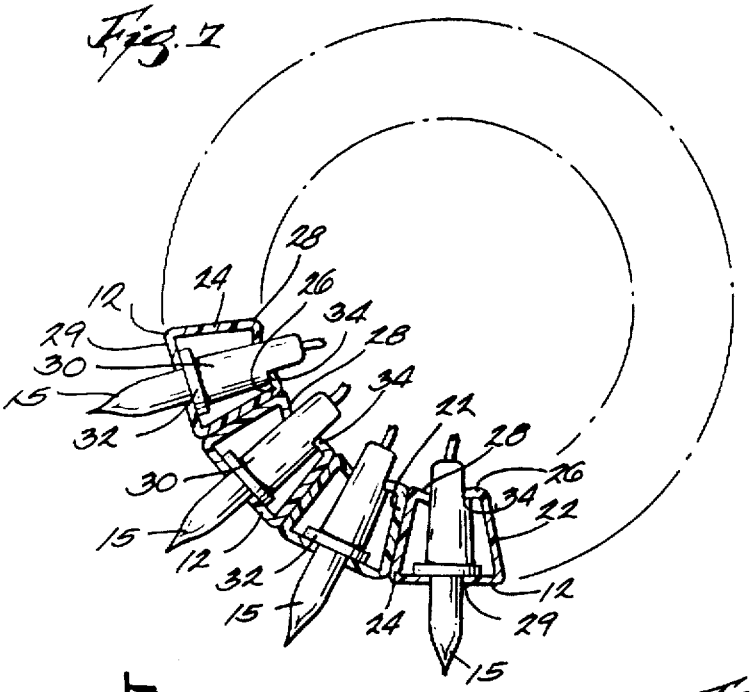
FIG. 7 is a fragmentary sectional view taken along line 7—7 in FIG. 6.
Figure 6:
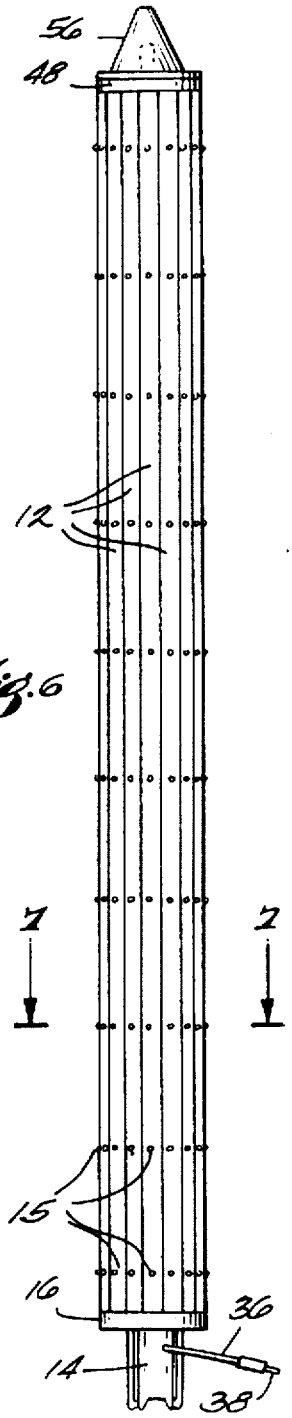
FIG. 6 is a side elevational view showing the device of the invention in the collapsed storage position.

As best seen in FIG. 7, each of strips 12 is provided with an outwardly exposed side having circular openings through each of which a light bulb 15 extends. Strips 12 have opposed lateral edges 22 and 24 which are sloped inwardly at an angle which enables all of the strips, when placed in the storage position shown in FIG. 6, to form an encircling assembly around central shaft 14. In the illustrated embodiment there are 15 strips 12 positioned around central shaft 14. This number of strips has been convenient, and preferred, in that a single string of miniature type Christmas tree lights will conveniently fit within and be supported by the channels of strips 12. However, it will be understood that a different number of strips 12 can be utilized and that the side surfaces 22 and 24 can be positioned at a slightly different angle appropriate for the number of strips 12 employed to fit together.

As further seen in FIG. 7, the sides 22 and 24 of strips 12 also have inwardly turned edges 26 and 28 which form a partial inner wall for strips 12 through which light bulbs 15 can be introduced or removed as needed.

It will be noted that the sockets 30 into which miniature style light bulbs 15 are conveniently each provided with a flange or ledge 32 which abuts against the inner side of strips 12 thereby enabling the light bulbs 15 only, to extend through openings 29 in strips 12. Light sockets 30 also, conveniently, usually have ledges 34 formed thereon, which are of a size adapted to snap under and to be retained by an edge 26 or 28, to thus securely hold the lights in place. In conventional fashion the light sockets are all connected electrically in by means of wires or cords 36 which are provided at their ends with a conventional electrical plug 38 for installation in the socket of an electrical outlet or extension cord.

Each of the strips 12 is provided with a section 40 which is the devoid of sidewalls 22 and 24. Sections 40 thus provide a point for folding of the strips 12 outwardly when sleeve 16 is raised along the length supporting shaft 14. The pivoting points defined by sections 40 are preferably located closer to the lower end of the assembly than to the top so that a conical shape is achieved as shown in FIG. 1 when sleeve 16 is moved to an elevation wherein ends 19 of clips 18 can be lodged in slots 20. Note also in FIGS. 4 and 5 that clips 18 have projecting flanges 17 which are provided to enable removal of ends 19 from slots 20 by pivoted caused by inward finger pressure against the projecting flanges 17.

Figure 8:
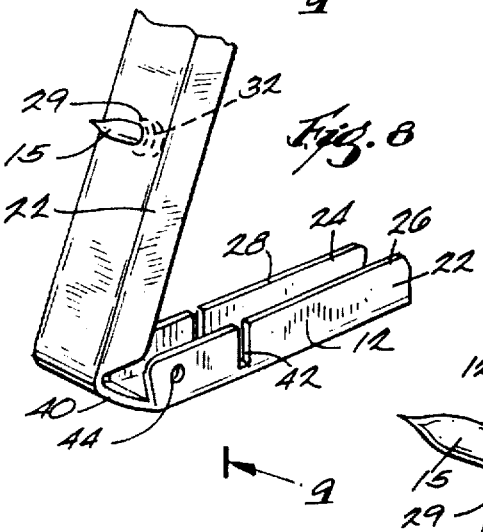
FIG. 8 is a fragmentary perspective view of a pivoting joint formed in the elongated supporting strips used in connection with the structure of the invention; and, FIG. 9 is a sectional view taken along line 9—9 of FIG. 8.
Figure 9:
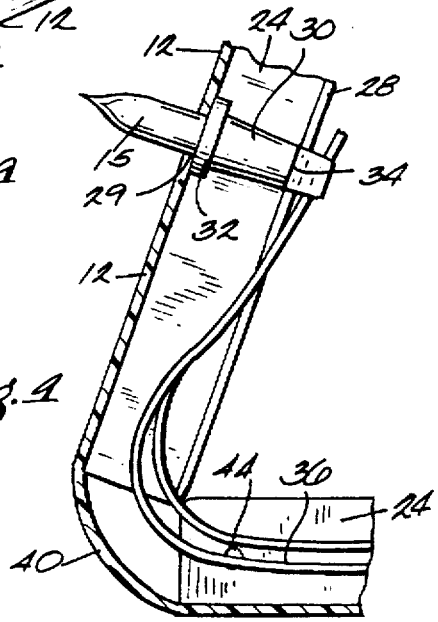

As also best seen in FIGS. 1 and 8, the lower ends of strips 12 are preferably provided with a plurality of slots or notches 42 which impart a degree of flexibility and curvature to the lower ends of strips 12 while the upper ends are relatively more rigid. Also provided in the strips 12 at a location just below pivot sections 40 are openings 44 which are adapted to receive an encircling restraining cord 45. Cord 45 is of benefit in assisting the assembly 10 in holding its shape even when adverse weather conditions, such as wind or blowing snow are encountered. Cord 45 is preferably attached to each strip 12 by means of glue, a clip or similar fastening means. An L-shaped tab 52 can be adhered to sleeve 16 corresponding to each strip 12. The ends 54 of tabs 52 provide surfaces for attachment of strips 12.

An upper plate 50 is also provided at the upper end of shaft 14 as best seen in FIG. 3. Connecting strips 46 are also connected to upper ends of strips 12 and to a downwardly depending flange 48 on plate 50. This arrangement will be observed to enable repeating pivoting of the upper ends of strips 12 toward and away from shaft 14 without failure on account of material fatigue.

Also located at the upper end of the device 10 is a translucent conical cap 56 which houses a bulb 58 which is adapted to extend through a central opening 57 in plate 50. This enables lighting of the conical cap 56 at the upper end of the device. Instead of a single bulb 58, a short string, for example, one with 10 miniature lights can be in inserted within cap 56 to provide a somewhat modified visual effect.

Device 10 can be mounted outdoors and secured to the ground 60 by means of a spike 62 which is centrally located through a hole in a short cylindrical shaft 64 preferably formed of plastic material. Shaft 64 has an outer dimension to fit snugly within the inside diameter of central supporting shaft 14. Thus the device can be easily installed by hammering the top of spike 62 to install shaft 64 above the ground surface and the central shaft 14 is installed thereover with the strips 12 in the conically expanded position. The device is then ready for illumination by installation of plug 38 into an electrically energized socket. Spike 62 can be provided with laterally extending fins to improve anchoring of the device in temperate climates or when soft ground is encountered, for example, for non-wintertime use.

It is preferred to construct the device 10 entirely out of plastic material such as polyvinyl chloride, high density polyethylene or other commercially available plastics. An exception, of course is spike 62 which would generally be formed of metal. It will also be appreciated that instead of a spike 62, shaft 64 can be attached to a suitable supporting base having laterally extending feet, so that device 10 can be placed in an indoor location. It will thus be appreciated that while during daylight only a conical structure as shown in FIG. 1 will be noted, that, in the darkness, when illuminated, the device will resemble a lighted Christmas tree. The device also can be provided with accessories for storage such as a suitable containing sleeve or a band, such as a Velcro strip, to retain the strips 12 in the elongated storage position of FIG. 6 for off season storage. The device of this invention can also be displayed in the collapsed position to form a "pillar of light."

While it is convenient to use a string of lights to provide illumination, other arrangements could be substituted. For example, a separate string of lights could be provided for each of strips 12.

Also, the device can be provided in alternate forms for use in seasons other than Christmas. For example, as depicted in FIG. 12, a lighting display appropriate for Valentine's Day or Halloween can be provided by altering the placement of the strips 12 and notches 42 formed therein.

Figure 10:
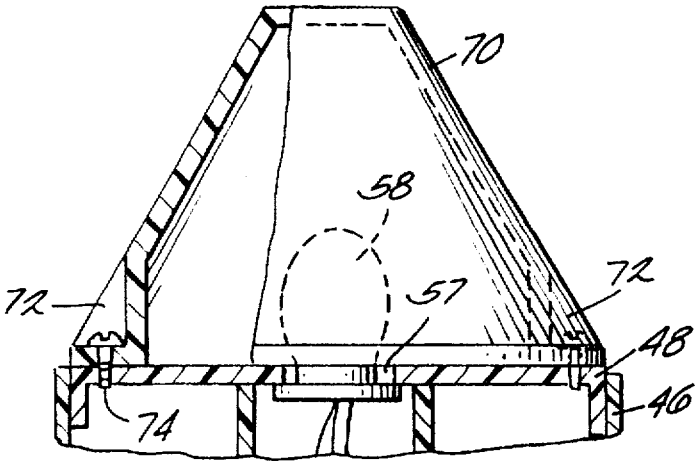
FIG. 10 is a fragmentary cross-sectional view showing an alternate form of an upper end cap for device of this invention.

Referring to FIG. 10, there is seen an alternative form of a cap 70 suitable for attachment to upper end plate flange 48. For that purpose, indentations are formed on two or more sides of the conically-shaped cap 70 and indentations 72 are formed on two or more sides of the conically-shaped cap 70. The bottoms of indentations 72 are provided with openings to facilitate placement of screws 74 for attachment of cap 70 to end plate flange 48.

Figure 11:
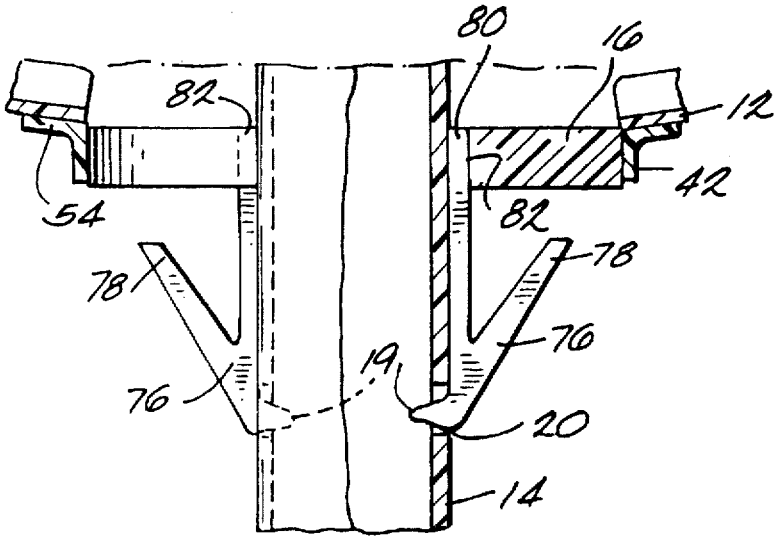
FIG. 11 is a fragmentary view with parts in section showing an alternative embodiment of a slidable collar and central supporting shaft assembled together.

An alternative form of clip 76 is illustrated in FIG. 11. Two or more clips 76 are provided in place of clips 18 to engage an opening 20 and central shaft 14. Extensions 78 are provided to enable flexing of the ends 19 of clip 76 out of openings 20 to permit sliding of the assembly along shaft 14. The upper ends 80 of clips 76 are adapted to be adhered within channels 82 cut into the interior edge of sleeve 16.

Figure 13:
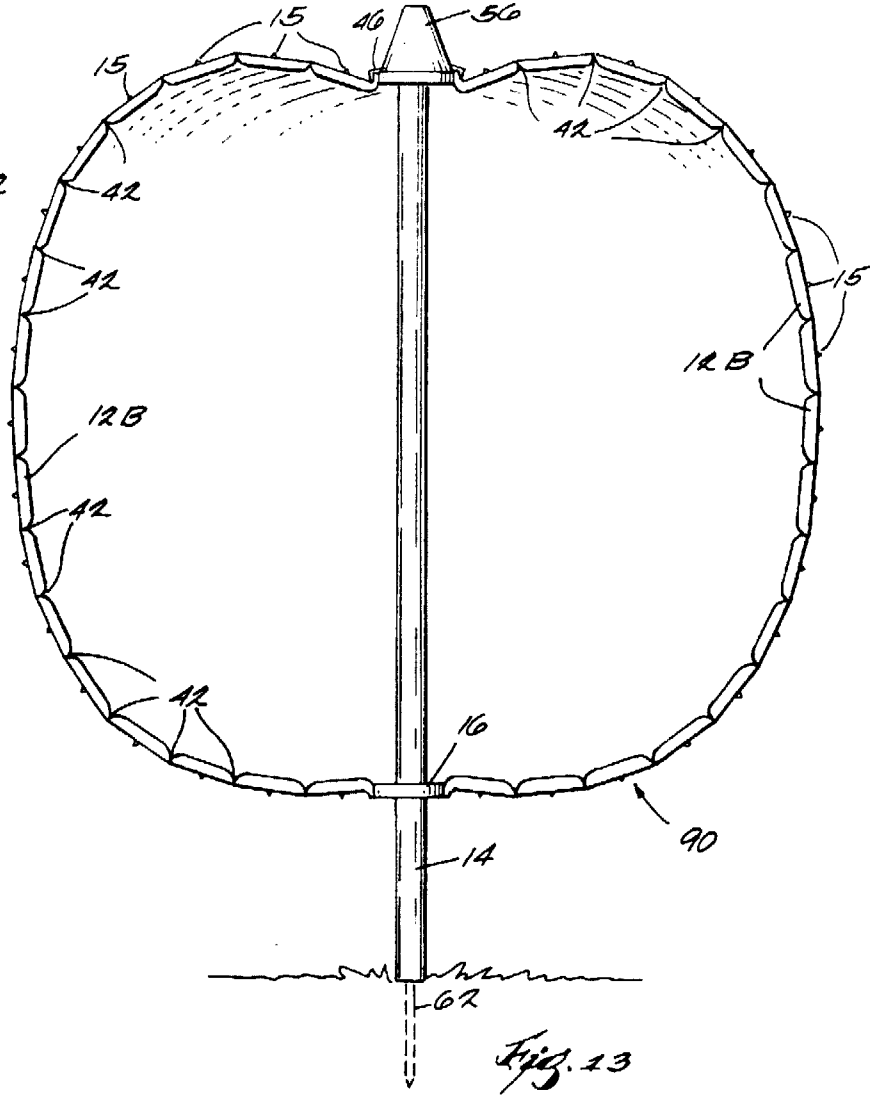
Figure 12:
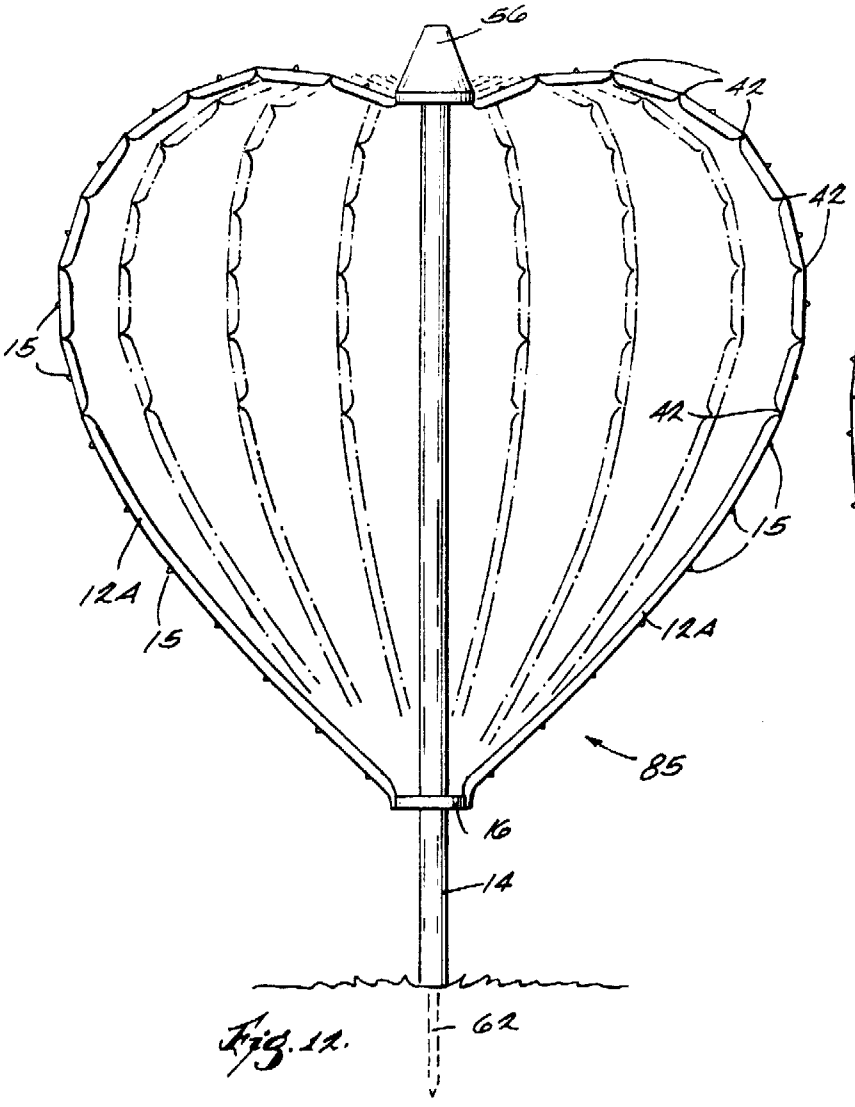
FIG. 12 is a side elevational view with some of the light supporting strips removed for clarity showing a lighting device of this invention suitable for use at Valentine's Day; and, FIG. 13 is a view showing schematically a lighting device suitable for use at Halloween.

FIGS. 12 and 13 illustrate alternative embodiments of the invention provided for differing seasons of the year. It will be noted that by appropriate placement of notches 42 and light supporting strips 12A, in the embodiment shown on FIG. 12, a generally heart-shaped lighting display 85 can be formed. In keeping with a Valentine's display, the lights 15 could be fitted with red or pink bulbs.

A still further form of display device 90 is shown in FIG. 13. Device 90 is suitable for use as a Halloween display. In this case, the notches 42 in strips 12B are formed so as to provide a pumpkin-shaped outline. Light bulbs 15 can be orange-colored bulbs. Upper conical cap 56 in such event could be fitted with a green bulb. Additionally, it will be apparent to those skilled in the art that lighting displays suitable for other seasons or occasions can be provided.

While preferred embodiments of the invention have been shown for the purposed of illustration, it will be understood various substitutes and changes may be made by those skilled in the art without departing from the concepts of the invention.

What is claimed is:

1. A lighting display device for simulating a selected lighted object, when illuminated, comprising a central shaft, a plurality of elongated support members each attached at one end to said shaft adjacent a first end of said shaft, at least one hinge formed in each of said support members and spaced away from said first end of said shaft, each of said support members having a generally C-shaped configuration with an open side facing said shaft and a closed side facing away from said shaft, a plurality of spaced openings through said closed side of each of said support members, each of said openings being adapted to receive a light bulb which is provided with means for illumination thereof, said bulbs extendable through said openings in a direction away from said shaft, said C-shaped configuration being adapted to receive and contain therein a plurality of light sockets supporting said light bulbs, the end of each said support members opposite said first end being moveable axially along said shaft, whereby each of said support members can be moved, from a substantially straight position suitable for storage of said device, to an erected position wherein each of said support members is folded outwardly from said shaft at said hinge, and, means to retain said axially moveable ends at a selected position relative to said shaft.

2. A device according to claim 1 wherein said support members have inwardly angled sidewalls on each side thereof which are each complementary with the side walls of an adjacent support member, whereby said support members, collectively, when in the elongated storage position, circumscribe said shaft.

3. A device according to claim 1 wherein a cylindrical collar is provided for supporting each end of said elongated support members on said shaft.

4. A device according to claim 2 wherein fifteen of said elongated support members are employed.

5. A display device according to claim 1 wherein said open sides of said C-shaped channels are bordered by inwardly extending edges and said sockets are adapted to snap fit under and to be retained by said edges.

6. A lighting display device which simulates a decorated, lighted tree, when illuminated, comprising a plurality of elongated support members attached at each end to a central shaft, the upper end of each member being hingedly attached to a stationary collar and the lower end being attached to a collar which is axially moveable along the shaft, a hinge being provided in each of the support members at a point spaced away from the ends thereof, each of the elongated support members having a plurality of spaced openings therethrough, said openings passing a through a surface of each of the support members which faces outwardly away from the shaft, each of the openings being adapted to receive a light bulb attached to a string of lights with each bulb extendable through one of said openings in a direction away from said central shaft, the elongated support members each having a C-shaped channel having an open side facing toward said shaft and a closed side having said surface facing away from said shaft which channel is adapted to receive and contain a plurality of light sockets supporting the light bulbs, each of the support members being movable, from a substantially straight position suitable for storage of the device, to an erect position wherein each of the support members is folded outwardly from the shaft at the hinge, thus forming a conical tree-like structure, when said movable collar is moved axially upward along the shaft.

7. A device according to claim 6 wherein said support members comprise generally C-shaped channels with an open side facing the shaft.

8. A device according to claim 6 wherein a hollow conical housing is provided at the upper end of said shaft, said housing being adapted to contain at least one light bulb for illumination thereof.

9. A device according to claim 7 wherein said hinge on each support member is formed by a section which is devoid of side walls.

10. A device according to claim 7 wherein each end of each of said elongated members is hingedly attached to one of said collars.

* * * * *